US006119318A

United States Patent [19]

Maurer

[11] Patent Number: 6,119,318

[45] Date of Patent: Sep. 19, 2000

[54] LACING AID

[75] Inventor: Richard A. Maurer, Carmel, Ind.

[73] Assignee: Hockey Tech L.L.C., Indianapolis, Ind.

[21] Appl. No.: 09/354,901

[22] Filed: Jul. 12, 1999

Related U.S. Application Data

[60] Provisional application No. 60/139,109, Jun. 14, 1999.

[51] Int. Cl.[7] ..... A43C 7/00; F16G 11/00

[52] U.S. Cl. ..... 24/713.2; 24/712.9; 24/713.6; 24/130

[58] Field of Search ..... 24/713.2, 713.3, 24/713.4, 713.6, 712.9, 130, 18

[56] References Cited

U.S. PATENT DOCUMENTS

| | | | |
|---|---|---|---|
| Re. 12,147 | 8/1903 | Priddat | 24/18 |
| 64,489 | 5/1867 | Christie . | |
| D. 357,576 | 4/1995 | Steinweis . | |
| D. 373,464 | 9/1996 | Hnarakis . | |
| D. 377,114 | 1/1997 | Crowley et al. . | |
| 421,321 | 2/1890 | Schoonmaker . | |
| 695,012 | 3/1902 | Telfer . | |
| 701,313 | 6/1902 | Duffy . | |
| 729,361 | 5/1903 | Lanz . | |
| 0,798,271 | 8/1905 | Donalds | 24/130 |
| 0,891,069 | 6/1908 | Howard | 24/712.9 |
| 0,986,014 | 3/1911 | Krenzke | 24/130 |
| 1,094,262 | 4/1914 | Spangenberg . | |
| 1,159,648 | 11/1915 | Champ . | |
| 1,163,573 | 12/1915 | Thayer . | |
| 1,242,774 | 10/1917 | Curry . | |
| 1,879,475 | 9/1932 | Poon . | |
| 1,995,243 | 3/1935 | Clarke . | |
| 2,271,288 | 1/1942 | Cuff | 24/130 |
| 3,715,782 | 2/1973 | Newell | 24/130 |
| 4,026,229 | 5/1977 | Winberg | 24/130 |
| 4,027,360 | 6/1977 | Moser . | |
| 4,125,918 | 11/1978 | Baumann . | |
| 4,507,878 | 4/1985 | Semouha . | |
| 4,553,342 | 11/1985 | Derderian et al. . | |
| 4,633,548 | 1/1987 | Siskind et al. . | |
| 4,899,466 | 2/1990 | Skaja . | |
| 4,970,763 | 11/1990 | Nwoko . | |
| 4,999,889 | 3/1991 | LeCouturer . | |
| 5,065,482 | 11/1991 | Lofy | 24/712.9 |
| 5,109,581 | 5/1992 | Gould . | |
| 5,158,428 | 10/1992 | Gessner et al. . | |
| 5,214,863 | 6/1993 | Skaja . | |
| 5,220,709 | 6/1993 | Boyland | 24/130 |
| 5,295,315 | 3/1994 | Osawa et al. . | |
| 5,345,697 | 9/1994 | Quellais . | |
| 5,566,474 | 10/1996 | Leick et al. . | |
| 5,755,044 | 5/1998 | Veylupek . | |
| 5,791,022 | 8/1998 | Bohman | 24/130 |

FOREIGN PATENT DOCUMENTS

| | | | |
|---|---|---|---|
| 0477197 | 9/1915 | France | 24/712.9 |

OTHER PUBLICATIONS

Catalog of G. Goldberg Co., Inc., 16 Proctor Street, Salem, MA 01970 (Also available on–line at www.shoeeye-lets.com/products/catalog.htm (2 pgs).

*Primary Examiner*—Victor N. Sakran
*Attorney, Agent, or Firm*—Woodard, Emhardt, Naughton, Moriarty & McNett

[57] ABSTRACT

A lacing aid is disclosed which quickly and surely guides and holds an elongated flexible member. The device includes a body, a plurality of fingers defining a slot between them and a fixation portion for fixation to a foot covering or other object to be tightened or fastened using an elongated flexible member. The fingers are bent with respect to the body to form a channel. The channel guides and assists in tightening an elongated flexible member, and the slot between the fingers enables the holding of the elongated flexible member without loss of tension.

26 Claims, 4 Drawing Sheets

LACING AID

This application claims the benefit of U.S. provisional application Ser. No. 60/139,109, entitled "LACING AID," filed on Jun. 14, 1999.

FIELD OF THE INVENTION

The present invention relates to devices used in connection with tightening laces or cords. Specifically, the present invention concerns devices which are attachable to footwear such as boots or other objects and which guide and/or control laces or cords used in association with those objects, enabling the laces or cords to be tightened and/or held in tension.

BACKGROUND OF THE INVENTION

Elongated flexible members, such as strings, laces or cords, are frequently used to close or connect associated bodies. For example, pieces of material having small holes can be laced together to form a garment. The lace is placed alternately through a hole in each piece of material (e.g. in a criss-cross pattern). When the ends of the lace are pulled, portions of the lace contacting the sides of the holes pull on them, forcing the pieces of material together. The lace may be pulled to tighten the connection between the pieces of material to any desired degree. The lace can be pulled relatively tight, bringing the material pieces relatively close together, or can be left relatively loose, leaving the material pieces relatively far apart.

Similarly, many varieties of footwear include an upper portion split into a left side and a right side by a gap. The wearer inserts a foot into the footwear between the sides of the upper, so that the top of the foot is adjacent the gap. Each side of the footwear upper includes a series of holes or eyelets through which a lace can be threaded. When the lace is properly inserted through the holes (e.g. in a criss-cross pattern), the ends of the lace can be pulled to draw together the right and left sides of the footwear upper, tightening the footwear onto the wearer's foot. An appropriate knot for the lace is then generally tied into the lace so that the right and left sides of the footwear upper stay in generally the same relative positional relationship, and therefore the same tightness is generally maintained with respect to the wearer's foot.

Further, such elongated flexible members are also used in connection with a variety of devices. For example, as shown in U.S. Pat. No. 4,027,360 to Moser, an elongated flexible member can be used to hold a tarpaulin or other cover on a truck bed. The cord is laced through one or more holes in the cover and may form one or more bights or loops. The bights or cord lengths can then be connected to the truck bed so as to hold the cover thereon.

Use of cords or laces to tighten or fasten two bodies together via holes in the bodies, while very common, has several disadvantages. Placing an elongated flexible member through a hole such as a footwear eyelet can be difficult for people who have difficulty working with small objects, such as the elderly, arthritis-inflicted persons, very young children, or the blind. Threading a lace through multiple holes is time-consuming and can be strenuous even for those without such difficulties. Further, once a shoe (for example) is laced, the lace must be tightened and knotted to preserve the tightened state. Frequently, after the lace is pulled tight, tension on the lace is released as the lace is knotted. When the tension is released, the lace can slip in one or more pairs of eyelets that were tightened earlier, causing the footwear to loosen around the foot to an undesirable degree.

Several devices have been developed to render laces or cords easier to use in footwear. Such devices are disclosed in, for example, U.S. Pat. Nos. 4,125,918; 4,970,763; 4,999,889; 5,109,581; 5,158,428 and U.S. Pat. No. 373,464. Generally, the devices disclosed therein suffer from one or more disadvantages, including inability to hold a lace in tension, an undesirably tall or large profile, and/or a multitude of parts and expense of manufacture.

Accordingly, there remains a need for a lacing aid that is inexpensive to manufacture and attach to a garment, footwear, or other body to be held or fastened by a lace or cord, which is aesthetically pleasing, and which allows for both speed lacing and holding a lace or cord in tension.

SUMMARY OF THE INVENTION

One form of the present invention contemplates a lacing aid having a body and a plurality of fingers forming a slot therebetween. The lacing aid is adapted to enable speed lacing of an object and to enable holding of a lace, cord or other flexible elongated member without loss of tension.

One object of the present invention is to provide an improved apparatus and method for lacing footwear, garments and other objects. Related objects and advantages will become apparent from the following description.

DESCRIPTION OF THE PREFERRED EMBODIMENT

Figure 1:
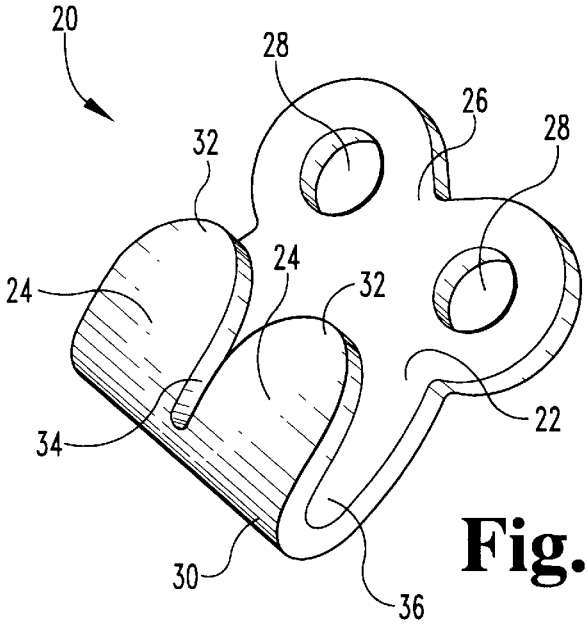
FIG. 1 perspective view of one embodiment of the lacing aid of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein, being contemplated as would normally occur to one skilled in the art to which the invention relates.

Figure 2:
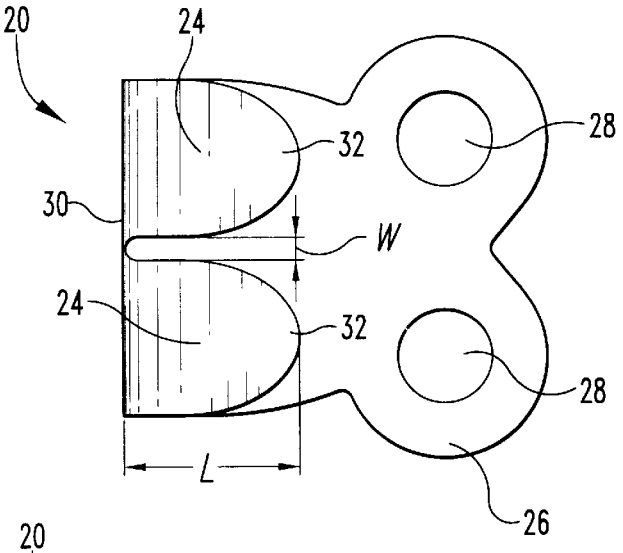
FIG. 2 is a top view of the embodiment of the lacing aid illustrated in FIG. 1.
Figure 3:
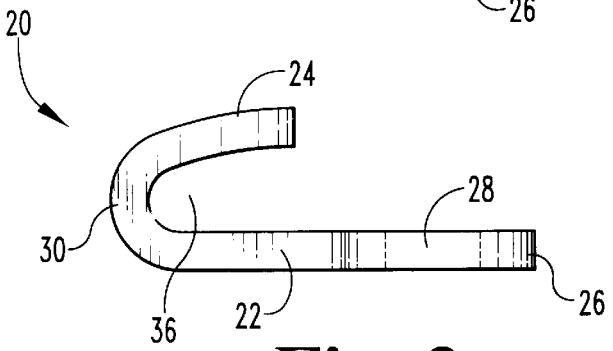
FIG. 3 is a side view of the embodiment of the lacing aid illustrated in FIG. 1.

Referring generally to FIGS. 1–3, a first embodiment of the lacing aid 20 of the present invention is illustrated. Lacing aid 20 includes a body 22 and a plurality of fingers 24 connected to body 22. Body 22 includes a fixing portion 26, which in the illustrated embodiment has a pair of bores 28 therethrough. Bores 28 are set apart from each other a distance that may be chosen according to the particular use intended for lacing aid 20. In one specific embodiment, for example, bores 28 are separated by a distance corresponding to the distance between two eyelets in footwear, a garment, or other device with which a lace or cord is used, though such correspondence is not strictly necessary to the invention. Fixing portion 26 could include an alternate number of bores 28, as dictated by size, strength and use considerations. It has been found that two bores 28 within fixing portion 26 provide sufficient anchoring strength in a lacing aid 20 sized to fit footwear such as a shoe, boot or skate. Body 22 and fixing portion 26 are generally flat in the illustrated embodiment, but may have an alternate configuration, e.g. curved or stepped, to cooperate with a non-flat surface and/or to provide additional mechanical advantage.

Fingers 24 are connected to body 22, and in the illustrated embodiment are integral with body 22. As seen in FIGS. 1 and 3, fingers 24 are joined to body 22 by a curved section 30. One or more of fingers 24, in one specific embodiment, have a rounded end portion 32. Each finger 24 is separated from an adjacent finger 24 by an open-ended slot 34. Rounded end portions 32 generally make it easier to guide and place a lace or cord in lacing aid 20 and particularly in slot 34. Slot 34 may have a substantially constant width W (see FIG. 2) along most of its length L. In an alternative embodiment, the width W of slot 34 may become narrower from the ends of fingers 24 toward curved section 30.

Lacing aid 20 is roughly in the shape of a J as viewed from the side, with fingers 24 having an angle of less than 90 degrees with respect to body 22. In the illustrated embodiment, fingers 24 make a relatively small angle with body 22, and portions or the entirety of fingers 24 may be parallel to body 22 or pointed toward body 22. Body 22, fingers 24 and curved section 30 define a channel 36. As described further below, an elongated flexible member, such as a lace or cord, is placed in channel 36 to assist in lacing and tightening an object to which lacing aid 20 is attached, by guiding and maintaining the elongated flexible member within channel 36. The elongated flexible member can also be wedged and held within slot 34, thereby keeping the elongated flexible member in a desired position and/or with a desired tension.

As noted above, in one embodiment body 22 and fingers 24 of lacing aid 20 are integrally formed. Lacing aid 20 is preferably made of a sturdy metal, for example brass, zinc or steel, which has been formed by a casting process. Other materials, such as sturdy plastics, could be cast or molded to manufacture lacing aid 20. Lacing aid 20 could also be manufactured by stamping a flat web of metal or other durable material. The stamping is then bent between body 22 and fingers 24 to provide the curved section 30 and J-shape of lacing aid 20.

Figure 4:
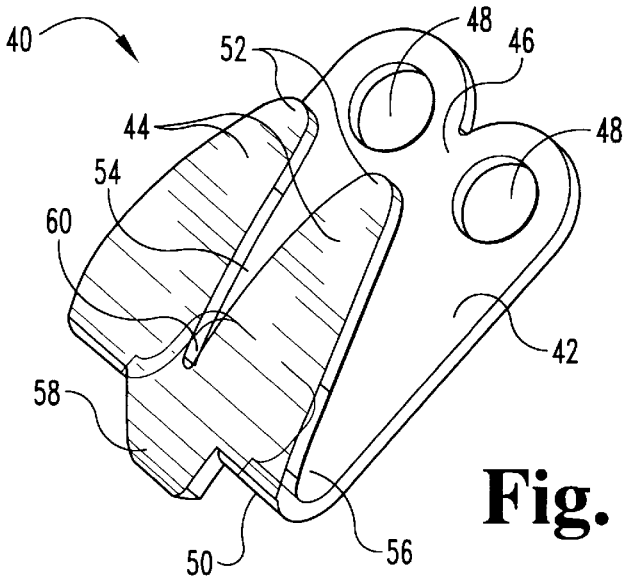
FIG. 4 is a perspective view of a second embodiment of the lacing aid of the present invention.
Figure 5:
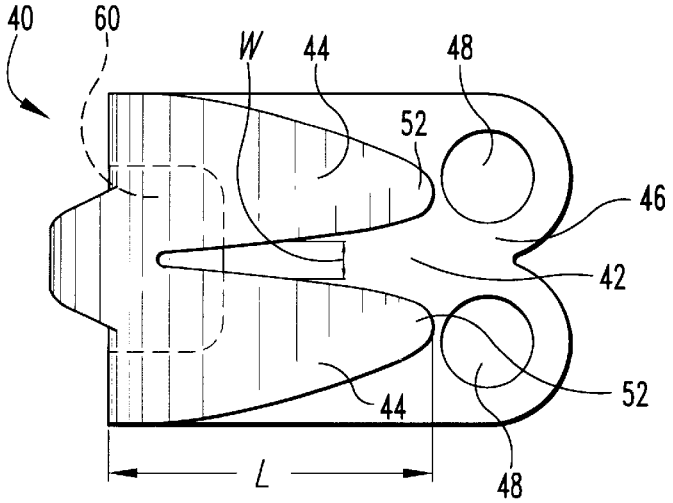
FIG. 5 is a top view of the embodiment of the embodiment of the lacing aid illustrated in FIG. 4.
Figure 6:
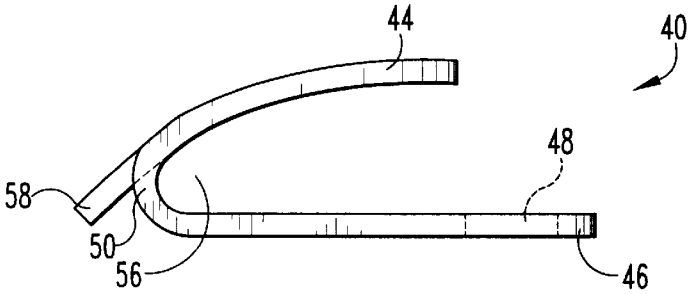
FIG. 6 is a side view of the embodiment of the lacing aid illustrated in FIG. 4.

Referring now generally to FIGS. 4–6, a second embodiment of a lacing aid 40 according to the present invention is illustrated. Lacing aid 40 is similar in many respects to lacing aid 20, and includes a body 42 and a plurality of fingers 44. Body 42 includes a fixing portion 46, which includes a pair of bores 48 therethrough. Bores 28 are set apart from each other a distance that may be chosen according to the particular use intended for lacing aid 20. In one specific embodiment, for example, bores 28 are separated by a distance corresponding to the distance between two eyelets in footwear, a garment, or other device with which a lace or cord is used, though such correspondence is not strictly necessary to the invention. Fixing portion 26 could include an alternate number of bores 28, as dictated by size, strength and use considerations. It has been found that two bores 48 within fixing portion 46 provide sufficient anchoring strength in a lacing aid 40 sized to fit footwear such as a shoe, boot or skate. As with lacing aid 20, body 42 and fixing portion 46 of lacing aid 40 are generally flat in the illustrated embodiment, but may have an alternate configuration, e.g. curved or stepped, to cooperate with a non-flat surface or to provide additional mechanical advantage.

Fingers 44 are connected to body 42, and in the illustrated embodiment are integral with body 42, and are joined to body 42 via curved section 50. Fingers 44 each include a rounded an end portion 52 in the illustrated embodiment, and fingers 44 bound an open-ended slot 54 between them. Curved section 50, rounded end portions 52 and open-ended slot 54 of lacing aid 40 are analogous to curved section 30, end portions 32 and slot 34 of lacing aid 20, and the corresponding parts of lacing aids 20 and 40 have similar functions.

Viewed from the side, fingers 44 and body 42 of lacing aid 40 form the rough shape of a J. Fingers 44 form an angle of less than 90 degrees with body 42, and preferably make a relatively small angle with body 42. Fingers 44 or end portions 52 can be formed to be parallel to or to point toward body 42. Body 42, fingers 44 and curved section 50 define a channel 56, analogous to channel 36 of lacing aid 20, through which a lace or cord can be placed.

The illustrated embodiment of lacing aid 40 also includes a flange 58 that extends from one or more of fingers 44. Flange 58 is preferably integral with fingers 44. Lacing aid 40 can also include an aperture 60 through body 42 and a portion of curved section 50. Flange 58 impedes the accumulation of grit or debris that can damage the object to which lacing aid 40 is attached or the lace with which lacing aid 40 is used.

Lacing aids 20, 40 have been illustrated as having two fingers 24,44 forming a single open-ended slot 34, 54. Lacing aids 20, 40 can be provided with additional fingers 24, 44 and additional corresponding slots 34, 54. Such additional fingers 24, 44 and slots 34, 54 can have dimensions different than other fingers 24, 44 and slots 34, 54 on the same lacing aid 20, 40, to allow use with laces of different cross-sectional size. Where multiple slots 34, 54 are provided in lacing aid 20, 40, a lace may be held by a single slot or multiple slots, as the user desires.

As with lacing aid 20, in one embodiment of lacing aid 40 body 42 and fingers 44 are integrally formed. Lacing aid 40 is preferably made of similar materials and by similar processes to those described above with respect to lacing aid 20.

Figure 7A:
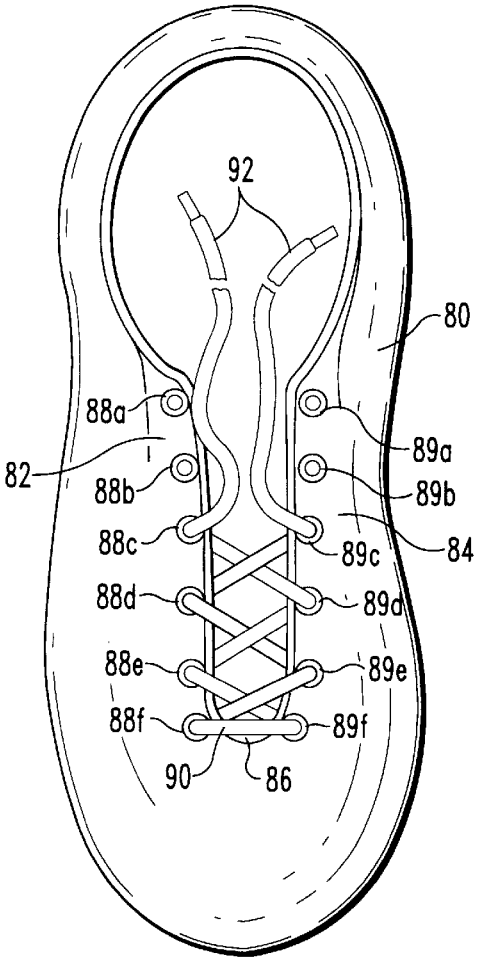
FIG. 7*a* is a top view of a standard foot covering with which the present invention can be used.
Figure 7B:
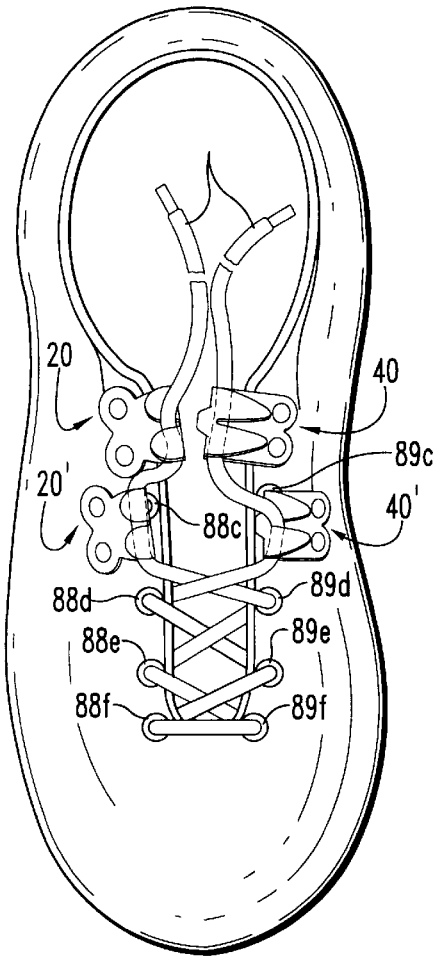
FIG. 7*b* is a top view of the standard foot covering illustrated in FIG. 7*a* with the embodiments of the lacing aid of the present invention illustrated in FIGS. 1 and 4 attached thereto.

The present invention can be used with a variety of objects that use an elongated flexible member such as a lace or cord to fasten or tighten a portion of the object. Referring now to FIGS. 7*a* and 7*b*, there is shown a use of the present invention with one such object, a foot covering 80. Such a foot covering can be any of a variety of footwear such as shoes, boots, skates, or similar objects.

Foot covering 80 generally includes two upper portions 82, 84 separated by gap 86. Upper sections 82, 84 include a series of eyelets 88*a*–88*f* and 89*a*–89*f*, respectively. In general usage of foot covering 80, a lace 90 is threaded through eyelets 88*a*–88*f* and 89*a*–89*f*. When the ends 92 of lace 90 are pulled, intermediate sections of lace 90 pull on eyelets 88*a*–88*f* and 89*a*–89*f* so that upper sections 82, 84 are pulled toward each other, the size of gap 86 is decreased, and foot covering 80 tightens around the wearer's foot.

Figure 8:
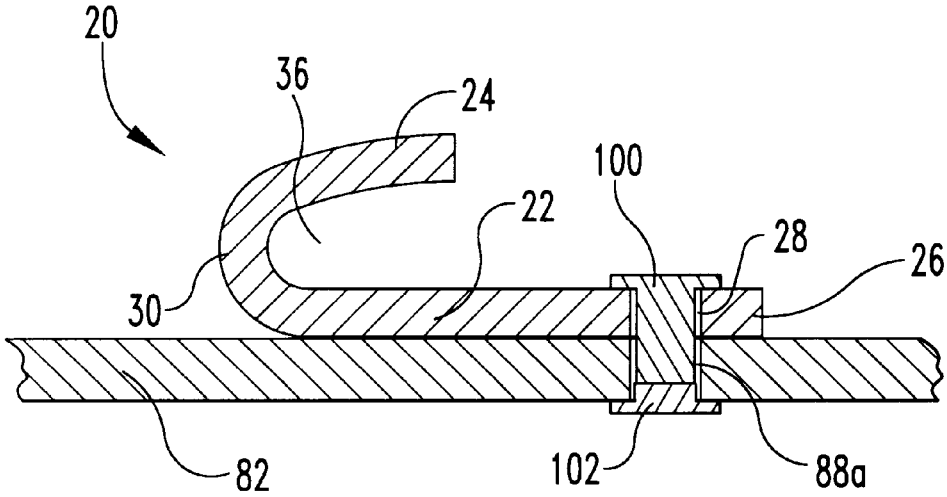
FIG. 8 is a cross-sectional view of the embodiment of the invention illustrated in FIG. 1 as attached to a portion of the foot covering illustrated in FIG. 7*b*.

Referring generally to FIGS. 7*b* and 8, the lacing aids of the present invention are shown as being attached to foot covering 80 by way of eyelet pairs 88*a*–88*b* and 89*a*–89*b*. Lacing aid 20 is shown attached to eyelets 88*a* and 88*b* to upper portion 82 of foot covering 80, and lacing aid 40 is shown as attached via eyelets 89*a* and 89*b* to upper portion 84. Additionally, another set of lacing aids 20' and 40' are shown attached directly to upper portions 82 and 84, respectively. Lacing aids 20' and 40' are not different in any meaningful way from lacing aids 20 and 40, except that they are not attached to foot covering 80 via any of eyelets 88*a*–88*f* or 89*a*–89*f*.

Referring generally to FIG. 8, there is shown lacing aid 20 attached to upper portion 82. The following description concerns attachment of lacing aid 20 to an object such as foot covering 80, and is equally applicable to attachment of lacing aid 40. Body 22 of lacing aid 20 is placed against upper portion 82 so that bores 28 of lacing aid 20 are substantially coaxial with eyelets 88*a* and 88*b* of upper portion 82. Lacing aid 20 and upper portion 82 are fixed with respect to each other via a fixing member inserted through bores 28 and associated eyelets 88*a* and 88*b*. In the embodiment of the invention illustrated in FIG. 8, the fixing member includes a male rivet member 100 and a female rivet member or locking collar 102. Female rivet member 102 may be positioned so that a portion of member 102 fits within eyelet 88*a*. Male rivet member 100 may then be inserted through hole 28 in lacing aid 20 and eyelet 88*a* and into female rivet member 102, so that members 100 and 102 are fixed with respect to each other and thereby hold lacing aid 20 and upper portion 82 fixed with respect to each other. Alternatively, other known fixation members such as screws, snaps or other known fasteners may be used. Adhesives or stitching through the material (not shown) of an object such as foot covering 80 applied to body 22 could also be used to fix lacing aids 20 or 40 to an object.

As noted above, the lacing aids of the present invention need not be placed directly over eyelets 88*a*–88*f* or 89*a*–89*f* provided in foot covering 80. Referring to FIG. 7*b*, lacing aids 20' and 40' are shown attached to the material (e.g. leather or other appropriate material) of foot covering 80. Holes corresponding to bores 28 of lacing aid 20' may be placed in upper portion 82, away from eyelets 88*a*–88*f*, and lacing aid 20' may be attached using rivets or other fasteners as described above. Placing the holes in upper portion 82 and attaching lacing aid 20' with fasteners could be accomplished in one step, for example by pushing a male rivet member through a bore 28 and upper portion 82 and into a female rivet member. In the same way, lacing aid 40' can be attached to upper portion 84 away from eyelets 89*a*–89*f*.

Referring again generally to FIGS. 7*a* and 7*b*, lacing aids of the present invention are demonstrated in use. The following description will pertain to one embodiment of the present invention, namely lacing aid 20. It will be seen that the same description will generally apply to the use of lacing aid 40. Initially, lace 90 is threaded through eyelets in foot covering 80 that are not associated with a lacing aid (e.g. eyelets 88*c*–88*f* and 89*c*–89*f* in FIG. 7*b*). One common method is to insert one end 92 of lace 90 into a lowermost eyelet 88*f* and the other end 92 into lowermost eyelet 89*f*. Ends 92 are then crisscrossed, so that the end 92 through eyelet 88*f* is threaded out through eyelet 89*e*, and the end 92 through eyelet 89*f* is threaded out through eyelet 88*e*. As shown in FIGS. 7*a*–7*b*, the threading of lace 90 continues until ends 92 are through eyelets adjacent to lacing aid (i.e. eyelet 88*c* for lacing aid 20, and eyelet 89*c* for lacing aid 40 in FIG. 7*b*).

Lace 90 is then placed within channel 36 of lacing aid 20. In a first mode, lacing aid 20 operates as a speed lacing aid. Lace 90 is moved around fingers 24 and into channel 36, allowing quick placement and tightening of foot covering 80. Pulling on ends 92 of lace 90 causes the portion of lace 90 within channel 36 to contact curved portion 30 and to pull lacing aid 20 and upper portion 82 toward upper portion 84, thereby tightening foot covering 80 on the wearer's foot.

In a second mode, lacing aid 20 functions to hold lace 90 in tension. In this mode, lace 90 is placed in a portion of channel 36 and placed in slot 34. As lace 90 is drawn into slot 34 toward curved portion 30 of lacing aid 20, lace 90 becomes wedged in slot 34, and is thereby held between fingers 24. Accordingly, when foot covering 80 has been tightened by applying tension to (i.e. pulling on) lace 90, the wearer can maintain the tension on lace 90 manually by gripping lace 90 and holding it in tension. The wearer can then place tensioned lace 90 between fingers 24 and within slot 34, thereby maintaining the tension on lace 90 without requiring the wearer to pull or hold lace 90. When lace 90 is held in tension by lacing aid 20, further operations can be performed on lace 90 or various portions of foot covering 80 without losing the tension on lace 90. For example, while lace 90 is held by lacing aid 20, a knot can be placed in the ends 92 of lace 90 as is well known to complete the tying or fastening of foot covering 80 onto the foot. As a further example, if lace 90 is held by lacing aid 20, a different portion of lace 90 (e.g., a portion along the opposite side of foot covering 80) may be further pulled and tightened without moving or losing the tension on lace 90.

The modes of operation of the lacing aids of the present invention can be combined. For example, multiple lacing aids 20 can be placed on one side of an object such as upper portion 82. In that case, lower lacing aid(s) 20 (i.e. further toward the toe of foot covering 80) may be used in speed-lacing mode, wherein lace 90 extends through channel 36 of each lacing aid 20, and an upper lacing aid 20 may be used to hold lace 90 at a desired tension. As another example, one or more lacing aids 20 can be used to hold lace 90 in tension, to keep a certain tightness of foot covering 80 at a given place on the wearer's foot such as the instep or ankle. Other lacing aid(s) 20 can be used in conjunction therewith as speed-lacing aids for ease in lacing and to vary the tension and tightness in other parts of foot covering 80.

As noted, lacing aid 40 operates in much the same manner as lacing aid 20. Lacing aid 40 is also capable of functioning in a speed-lacing mode and in a tension-holding mode, with channel 56 of lacing 40 providing a guide and speed lacing ability for lace 90, and fingers 44 and slot 54 having the ability to hold lace 90 in tension. Lace holder 40 also includes flange 58 and aperture 60 which can also be used to hold lace 90, as described above.

In practice, it is likely that one would use a single embodiment of the lacing aid of the present invention on a given object, i.e., only lacing aids 20 or only lacing aids 40 would be used with a particular foot covering or other object. However, nothing would prevent a user from mixing lacing aids 20 and 40 together and/or with other devices in a manner like that shown in FIGS. 7*a* and 7*b*. Further, it is likely that one would use multiple lacing aids of the present invention with a given object. In the case of foot covering 80, lacing aids can be placed in any or all of the existing eyelets 88*a*–88*f* and 89*a*–89*f*.

It will be appreciated that lacing aids 20 and 40 shown and described above can be used as a retrofit or "add on" for existing foot coverings having eyelets. The lacing aids of the present invention can also be attached to foot coverings and other objects "OEM" at the factory, without the need for retrofitting them with the lacing aids of the present invention.

Lacing aids 20, 40 can be dimensioned to suit the application for which they will be used. One present form of lacing aid 20 which is found to work well with many standard foot covering varieties is approximately 18 millimeters in length from the rightmost point of fixing portion 26 (see FIG. 2) to the line on curved portion 30 most distant from that point. The width of fixing portion 26 is approximately 18 millimeters, and the distance between the centers of bores 28 is approximately 12 millimeters. The width of body 22 is about 14 millimeters, and the length L (FIG. 2) of fingers 24 is about 9 millimeters. It will be appreciated that similar dimensions applied to lacing aid 40 will also work, and that different dimensions for lacing aids 20, 40 will be appropriate for other objects.

The present invention has been described above with specific reference to a foot covering, such as a shoe, boot, or skate. It will be observed that the present invention is not however, limited to such applications. The present invention can be used in connection with garments, coverings or other objects that can be tightened or fastened using flexible elongated members like ropes, laces, or cords. Similarly, the lacing aids of the present invention can be used in sporting applications in which a flexible member needs to be tightened or held in tension.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A lacing aid for footwear capable of use as a speed lacing aid and as a lace gripping device, comprising:

a body portion including a fixation portion attached to footwear;

a connecting portion connected to said body portion and defining a channel adapted to accommodate the lace for speed lacing; and a plurality of fingers connected to said connecting portion, said fingers each having a substantially linear edge defining at least one slot therebetween, said slot being substantially perpendicular to said channel, and having a width dimension and a length dimension, and said width dimension is at its smallest adjacent to said connecting portion, said fingers and said slot being adapted to grip said lace when said lace is placed within said slot, by pinching said lace between and in contact with said edges of said fingers that define said slot.

2. The apparatus of claim 1, wherein said connecting portion is curved.

3. The apparatus of claim 2, further comprising a flange connected to said curved connecting portion and extending away from said fingers.

4. The apparatus of claim 3, further comprising an aperture through said connecting portion and proximate to said flange.

5. The apparatus of claim 1, wherein said width dimension of said slot tapers substantially uniformly along at least a portion of said length dimension.

6. The apparatus of claim 1, wherein said slot has a width dimension and a length dimension, and said width dimension is substantially constant along substantially all of said length dimension.

7. The apparatus of claim 1, wherein said fixation portion comprises at least one bore through said body.

8. The apparatus of claim 7, further comprising a fastener adapted to attach said apparatus to said separate member through said bore of said fixation portion.

9. The apparatus of claim 1, wherein said fixation portion includes a portion configured to matingly cooperate with a surface of the footwear.

10. A lacing assembly for securing an article of footwear onto the foot of a user, said lacing assembly comprising:

a plurality of lacing aids, each of said lacing aids including a body having a fixation portion, each of said lacing aids further including a plurality of fingers connected to said body by a curved connecting portion, said fingers each having a substantially linear edge defining at least one tapered slot therebetween, and said fingers having at most one substantially continuous curve that is one of concave and convex, wherein said lacing aids are fixed to the article of footwear at said fixation portion; and a lace operationally connected to at least one of said lacing aids such that a portion of said lace is placed in one of a first and second position, said first position being along said curved connecting portion and between said body and said fingers, said second position being within said slot of said lacing aid, so that when a portion of said lace is within said curved connecting portion and said lace is pulled, the article of footwear is tightened on the user's foot, and when a portion of said lace is lodged within said slot, said portion of said lace is gripped therein by pinching between said edges of said fingers.

11. The assembly of claim 10, wherein the article of footwear includes at least one upper portion, and said lacing aids are fixed to said at least one upper portion of the article of footwear.

12. The assembly of claim 11, further comprising means for fastening said fixation portion of said lacing aids to said at least one upper portion of the article of footwear.

13. The assembly of claim 12, wherein said fastening means comprises a male rivet member and a female rivet member.

14. A method for lacing, comprising the steps of:

providing a first member having at least one lacing aid, said at least one lacing aid comprising a body portion including a fixation portion for attachment to said member, a connecting portion connected to said body portion, and a plurality of fingers connected to said connecting portion, the fingers each having a substantially linear edge defining at least one tapered slot therebetween, and said fingers having at most one substantially continuous curve that is one of concave and convex;

providing a second member and a lace operationally connected to said second member;

placing said lace along the connecting portion and between the body portion and fingers of at least one of said lacing aids;

applying tension to a portion of said lace so that said at least one of said lacing aids is under tension along with said lace portion;

placing a portion of said lace within the slot between the fingers of at least one of said lacing aids, so that said fingers grip said lace by pinching said lace to maintain the tension on said lace; and fastening said lace so that said first member and said second member are held in a desired spatial relationship.

15. The method of claim 14, wherein said first member and said second member are portions of an item of footwear.

16. The method of claim 15, further comprising the steps of forming a hole in said first member and fixing one of said at least one lacing aids to said first member through said hole.

17. The method of claim 15, wherein one of said at least one lacing aid is fixed to said first member through pre-existing lacing eyelets formed in said first member.

18. The method of claim 15, further comprising the step of providing a plurality of said lacing aids fixed to said first member.

19. The method of claim 15, further comprising the step of providing at least one of said lacing aids fixed to said second member, wherein said lace is operationally connected to said at least one of said lacing aids fixed to said second member.

20. The method of claim 14, wherein said slot is substantially uniformly tapered.

21. A footwear lacing aid adapted for use with a footwear lace in both a speed lacing mode and in a lace gripping mode, comprising:

a body portion including a fixation portion, said fixation portion adapted to be attached to a piece of footwear;

a connecting portion connected to said body portion and defining a channel, said channel adapted to have a lace placed therein and to enable speed lacing of the lace; and a plurality of fingers connected to said connecting portion, said fingers each having a substantially linear edge defining at least one slot therebetween, said slot being substantially perpendicular to said channel, said fingers being adapted to grip said lace when said lace is placed in a portion of said slot adjacent said connecting portion, by pinching said lace between said edges of said fingers, wherein said lacing aid operates as a speed lacing aid when a lace is placed within said channel, and said lacing aid operates as a lace gripping aid when a lace is placed within said slot.

22. The apparatus of claim 21, further comprising a flange connected to said curved connecting portion and extending away from said fingers.

23. The apparatus of claim 22 further comprising an aperture through said connecting portion and proximate to said flange.

24. The apparatus of claim 21, wherein said slot includes a lace-gripping portion adjacent to said connecting portion, said lace-gripping portion having a width less than the width of the lace.

25. The apparatus of claim 24, wherein said slot has a width dimension, and said width dimension tapers substantially uniformly along at least a portion of the length of said fingers.

26. The apparatus of claim 24, wherein said slot has a width dimension, and said width dimension is substantially constant.

* * * * *

UNITED STATES PATENT AND TRADEMARK OFFICE

CERTIFICATE OF CORRECTION

PATENT NO. : 6,119,318
DATED : September 19, 2000
INVENTOR(S) : Richard A. Maurer It is certified that error appears in the above-identified patent and that said Letters Patent is hereby corrected as shown below:

Column 1,
Line 64, delete "knofted" and insert -- knotted --.

Column 2,
Line 4, insert -- Design -- directly after "U.S."
Line 28, insert -- is a -- directly after "1".

Signed and Sealed this

Twenty-ninth Day of January, 2002

*Attest:*

*Attesting Officer*

JAMES E. ROGAN
*Director of the United States Patent and Trademark Office*